United States Patent [19]

Warner

[11] 4,435,903

[45] Mar. 13, 1984

[54] LEFT-HANDED LETTERER

[76] Inventor: Philip E. Warner, 56 Hilton Rd., Mount Holly, N.J. 08060

[21] Appl. No.: 295,707

[22] Filed: Aug. 24, 1981

[51] Int. Cl.[3] ..... B43I 13/10
[52] U.S. Cl. ..... 33/23 D
[58] Field of Search ..... 33/23 D

[56] References Cited

U.S. PATENT DOCUMENTS

| | | | |
|---|---|---|---|
| 2,050,058 | 8/1936 | Keuffel | 33/23 D |
| 2,616,179 | 11/1952 | Anderson | 33/23 D |
| 2,686,971 | 8/1954 | Valois | 33/23 D |
| 2,720,030 | 10/1955 | Anderson | 33/23 D |
| 3,250,008 | 5/1966 | Heisley | 33/23 D |
| 3,555,686 | 1/1971 | Hatem | 33/23 D |

FOREIGN PATENT DOCUMENTS

| | | | |
|---|---|---|---|
| 379579 | 9/1932 | United Kingdom | 33/23 D |

*Primary Examiner*—Harry N. Haroian
*Attorney, Agent, or Firm*—C. Emmett Pugh & Associates

[57] ABSTRACT

A lettering device for drawing characters for use in connection with a lettering template having character grooves and a horizontal guide pin groove, the combination of a guide pin, a tracer pin, and a means for holding a writing instrument, each at the vertices of a right triangle, said tracer pin, being located at the right angle vertex. The knobe handle for the device is located outside of and adjacent to that leg of the right triangle which interconnects said tracer pin and said writing instrument means, whereby the device can be manipulated by the left hand.

5 Claims, 8 Drawing Figures

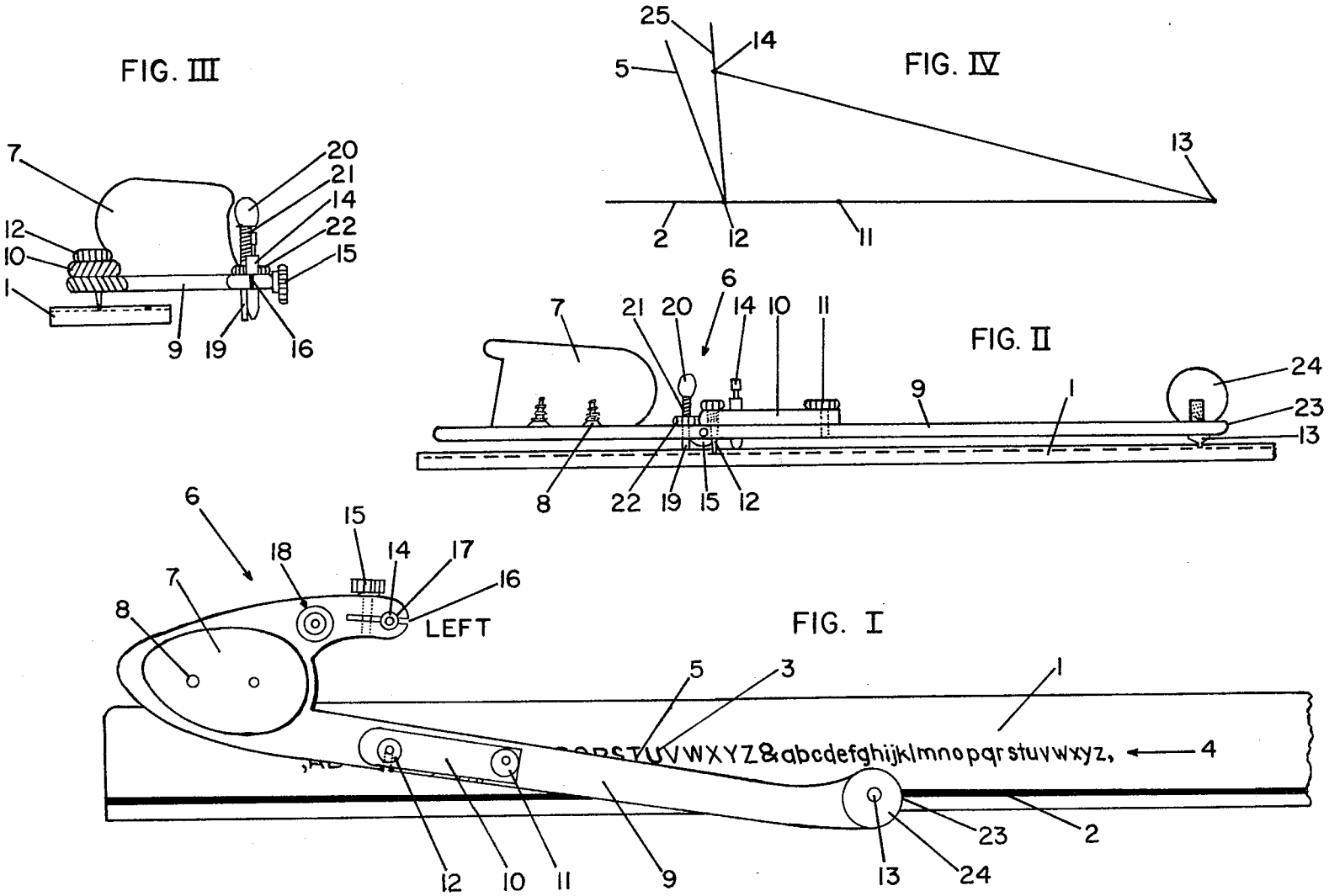
FIG. IV
FIG. II
FIG. I
FIG. III
LEFT

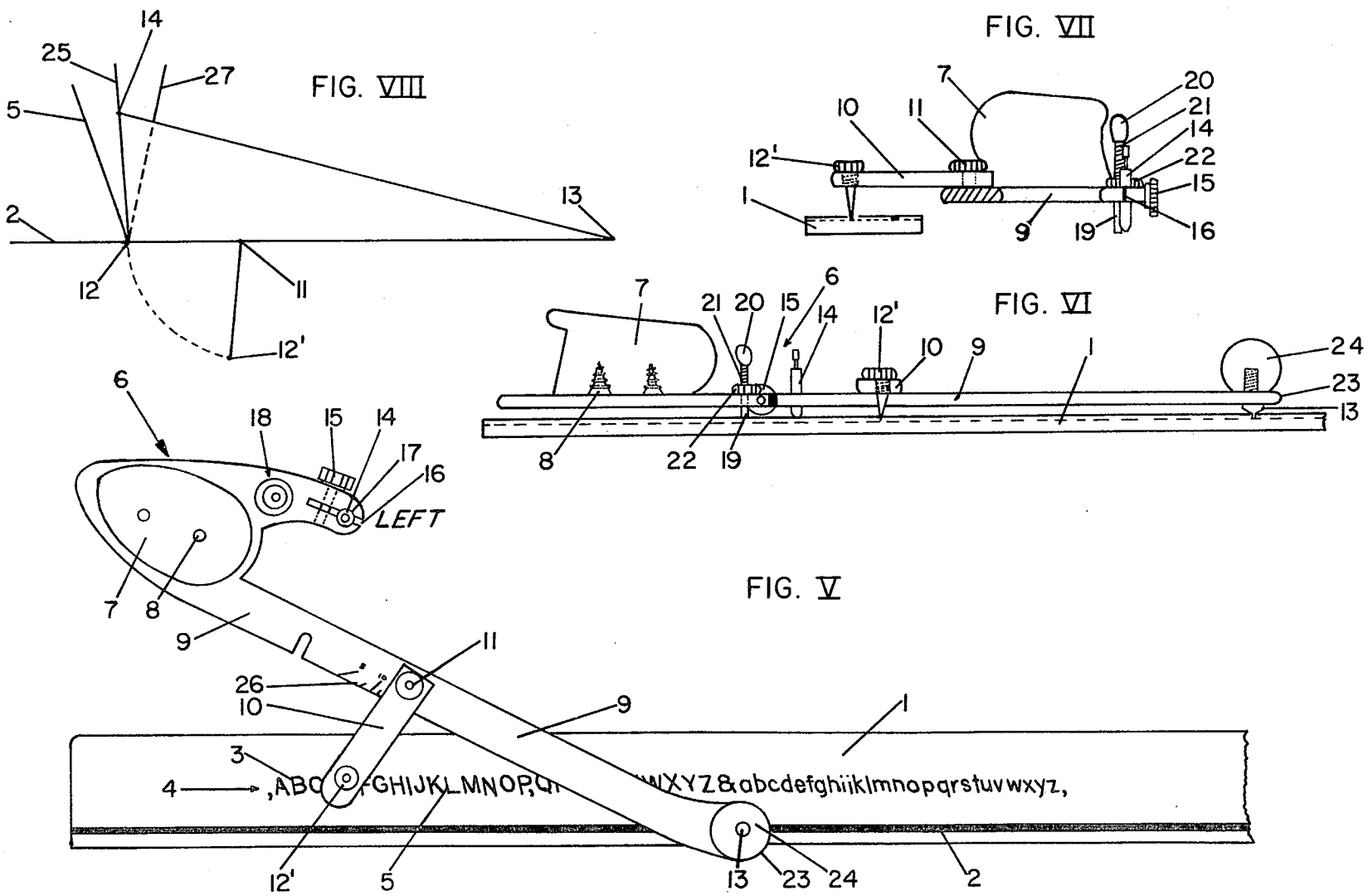
FIG. VII
FIG. VI
FIG. V
FIG. VIII
LEFT

LEFT-HANDED LETTERER

BACKGROUND OF INVENTION

1. Field of Invention

This invention relates to lettering or scribing devices of the kind in which a writing instrument is carried by a scriber member and is directed over the surface to be written upon by a tracer pin moving in character grooves or the like formed in a template and by a guide pin moveable in a groove or the like parallel with the line of lettering. The writing instrument carried by the scriber may be either a pen, pencil or ball point pen.

2. Prior Art

The prior U.S. patents listed below are noted:

| U.S. Pat. No. | Patentee | Issue Date |
|---|---|---|
| 2,050,057 | Keuffel | August 4, 1936 |
| 2,050,058 | Keuffel | August 4, 1936 |
| 2,557,152 | Smith, et. al. | June 19, 1951 |
| 2,616,179 | Anderson | November 4, 1952 |
| 3,192,629 | Morrison | July 6, 1965 |

Devices of the character described, such as those shown in U.S. Pat. Nos. 2,050,057, 2,050,058, 2,557,152, and 2,616,179 have heretofore had an inherent limitation in their design and construction, in that the said scriber member could not be used with the left hand.

3. Summary Discussion of Invention

One objective of the invention is to provide a lettering device in which the writing instrument can be manipulated by the left hand.

Another objective of the invention is a simple device to prevent the accidental displacement of the guide pin from the horizontal groove. Accordingly, that end of the body with which the guide pin is carried is weighted.

Another objective of the invention is to provide a lettering device in which the writing instrument travels in a straight line.

Another objective of the invention is to provide a lettering device with an adjustable arm capable of forming inclined letters of various slopes, but in which the writing instrument travels in a straight line regardless of the slope of the lettering.

A further objective of the invention is to provide a lettering device capable of forming inclined letters of various slopes directly proportional to adjustment of the moveable arm and having a means for indicating the slope of the inclined letters clearly and simply.

BRIEF DESCRIPTION OF DRAWINGS

These and other objectives of the invention and the means for their attainment will be more apparent from the following detailed description taken in connection with the accompanying drawings illustrating two preferred embodiments of the invention and in which:

FIG. I is a view in plan of an embodiment for drawing vertical letters or characters.

FIG. II is a view in elevation of the embodiment shown in FIG. I.

FIG. III is a fragmentary sectional view showing the writing instrument, raising screw, and the tracer pin arm.

FIG. IV is a diagrammatic sketch showing the geometrical arrangement of the essential parts in FIG. I.

FIG. V is a view in plan of an embodiment for drawing sloping letters or characters.

FIG. VI is a view in elevation of the embodiment shown in FIG. V.

FIG. VII is a fragmentary sectional view showing the writing instrument, raising screw, and the tracer pin arm in rotated position.

FIG. VIII is a diagrammatic sketch showing the geometrical arrangement of the essential parts in FIG. V.

DETAILED DESCRIPTION OF PREFERRED EMBODIMENTS

Referring to FIGS. I, II, and III, the template 1 is provided with a horizontal groove 2 and character grooves 3 which lie in a row 4.

The body member 6 is made up of a knob 7 fastened as by screws 8 to the scriber plate 9. The scriber plate 9 has a tracer pin arm 10 held in place by the tracer pin arm screw 11 which is an integral part thereof. The tracer pin arm 10 carries the tracer pin 12 which operates in the character grooves 3. The guide pin 13 operates in the horizontal groove 2 of the template 1.

The pen 14 is removable and is held in position by the clamp screw 15 on the scriber plate 9. The clamp slot 16 from the edge inward may be drawn together by the clamp screw 15 holding the pen 14 firmly in place in the hole 17. The height adjustment screw 18 comprises a threaded shank for reception in the aperture and a blunt bearing end 19 which rests and slides over the writing surface. It has a head 20 by which the shank 21 is turned in the threaded aperture and locked in position by the lock nut 22. The elevation of the pen 14 is adjusted above the surface, and thus the mouth of the pen's delivery nozzle is maintained at the proper distance above the writing surface.

The guide pin 13 slides freely in the horizontal groove 2 of the template 1 as the tracer pin follows, in the character groove 3, the outline of the character being inscribed. To retain the guide pin 13 in the horizontal groove 2, the extremity of the end is weighted. This weight 24 is formed with a threaded cylindrical recess adapted for threaded engagement with the screw. By means of the weighted end, the scribing device may be moved back and forth along the template about the axis of the guide pin without danger of the guide pin leaving the horizontal groove.

Referring to FIG. IV, the scriber plate is formed so that the guide pin 13, tracer pin 12, and writing instrument 14 are the vertices of a right triangle. The straight character groove 5 which would be the character groove for the vertical part of the capital letter "L" or the numeral "1" or the vertical line in any letter is formed in the template such that the angle between the vertical line drawn and the character groove is that of a predetermined value. As would be clear to a person of ordinary skill in this art, the knob 7 serves as a handle to be held with the hand of the user for manipulating the lettering device on the letter template 1. As can be seen from comparing FIGS. I and IV, the knob 7 lies outside of the right triangle and adjacent and closest to the portion of the body 6 which interconnects the writing instrument 14 and the tracer pin 12.

If the device is made according to the geometric arrangement shown in FIG. IV and described above, when the tracer pin 12 moves along the character groove 5 or along any portion of the groove 5 within the limits permitted by the device and the guide pin 13 moves along the horizontal groove 2, the writing instrument 14 will move along the vertical line 25. If the character groove 5 is a straight line, the line drawn by the writing instrument will also be a straight line.

In FIGS. V, VI, and VII the template 1 is again shown provided with a horizontal groove 2 and character grooves 3 in a row 4. On the scriber plate 9 is the adjustable tracer pin arm 10 held in place by a tracer pin arm screw 11. The knob 7 is securely fastened to the scriber plate 9 as by the screws 8. The weight 24 shown is provided in order to hold the guide pin 13 in the horizontal groove 2. The height adjustment screw 18 can be adjusted to maintain the pen's delivery nozzle at the proper distance above the writing surface. The tracer pin arm 10 carries the tracer pin 12 which operates in the character grooves 3. The pen 14 is removable and is held in position on the scriber plate 9 by the clamp screw 15.

The scriber plate 9 is provided with an angular scale 26. The adjustable tracer pin arm 10 can be set by aligning the edge of the tracer pin arm 10 with the calibrations of the angular scale 26. The calibrations are the slope of which the vertical part of the capital letter "L" or the numeral "1" will be formed on the writing surface.

As previously stated in connection with FIG. IV, a fixed device having the geometrical arrangement so far described will draw straight undistorted vertical characters from a template provided with straight undistorted characters on the template but must be backwardly inclined an amount of a predetermined angle.

Referring to the diagrammatic sketch shown in FIG. VIII, the tracer pin arm 10 has been swung through an arc pivoted on the tracer pin arm screw 11. The tracer pin 12 is brought into an adjusted position 12'. The points 12 and 12' in FIG. VIII are equally distant from the point 11.

If the device is made according to the described geometric arrangement with the tracer pin arm in its adjusted position 12', and moved in the vertical character groove segment, the pen will move along a straight line 27 inclined forward on the angle as shown on the angular scale calibrations 26 when the tracer pin follows the straight character groove 5 and the guide pin 13 follows the straight horizontal groove 2.

Therefore, such a device with the adjustable tracer pin arm 10 having been turned through an arc so that the tracer pin arm 10 is in adjusted position 12' will draw straight undistorted characters forwardly inclined by an angle as shown on the calibrated angular scale from a template provided with straight undistorted characters which lie in a row on the template but must be backwardly inclined an amount of a predetermined angle.

It will thus be seen that a scribing device has been provided in which the body may be readily cast of relatively light metal. By its shape, it is conveniently held and manipulated with the left hand by the user. By the weighted end, the guide pin is retained in the horizontal groove during movement of the device and by means of the height adjustment screw, the writing instrument is maintained at the proper relative position with respect to the writing surface with little effort on the part of the user. The draftsperson is not limited, by the scribing device of this invention, to any particular size, weight or inclination of lettering, all such being determined by the character grooves of the template.

Various modifications will occur to those skilled in the art in the composition, configuration and disposition of the component elements going to make up the invention as a whole, as well as in the substitution therein of elements performing equivalent functions, and no limitation is intended by the phraseology of the foregoing description or illustrations in the annexed drawings.

What is claimed is:

1. A lettering device for drawing characters for use in connection with a lettering template having character grooves and a horizontal guide pin groove, comprising:

a body;

a guide pin;

a tracer pin; and writing instrument holding means for holding a writing instrument; said guide pin, said tracer pin and said writing instrument holding means being located at three spaced positions on said body at vertices of a right triangle, said tracer pin being located at the right angle vertex; and knob means on said body for providing an element to be held with the hand of the user for manipulation of the lettering device on the lettering template, said knob means being located outside of said right triangle adjacent and closest to that leg of the right triangle which interconnects said writing instrument holding means and said tracer pin; whereby the lettering device can be easily manipulated by the left hand of the user.

2. The lettering device of claim 1, wherein said body includes:

a scriber body member having said guide pin and said writing instrument holding means secured thereto;

an adjustable member carrying said tracer pin and moveably connected to said scriber body member;

pivot means on said scriber body member for rotating said tracer pin away from the vertex of said right triangle for drawing inclined characters, said adjustable member being pivotally attached to said scriber body member at said pivot means; and holding means connected to said adjustable member to hold said adjustable member in an adjusted position away from the vertex of said right angle.

3. The lettering device of claim 2, wherein said pivot means is located on quarter of the distancce from said tracer pin along the adjacent said of said right triangle between said tracer pin and said guide pin when said tracer pin, said pivot means and said guide pin are aligned.

4. The lettering device of claim 2, wherein there is further included on said body a scale to show the adjusted position of said adjustable member.

5. The lettering device of claim 1, wherein said writing instrument holding means comprises a portion of said body defining a hole for receiving the writing instrument, a slot extending from the hole to an edge of said body, and clamp means on said body adjacent to the slot for holding the writing instrument in place.

* * * * *